United States Patent [19]

Demay

[11] Patent Number: 4,813,185

[45] Date of Patent: Mar. 21, 1989

[54] JIG OR OTHER TOOLING ARRANGEMENT

[75] Inventor: Pierre Demay, La Frette sur Seine, France

[73] Assignee: Societe Nationale d'Etude et de Construction de Moteur d'Aviation, Paris, France

[21] Appl. No.: 25,061

[22] Filed: Mar. 12, 1987

[30] Foreign Application Priority Data

Mar. 13, 1986 [FR] France ..... 86 03556

[51] Int. Cl.[4] ..... B24B 19/00

[52] U.S. Cl. ..... 51/7; 51/217 R; 51/237 T; 269/43

[58] Field of Search ..... 51/7, 19, 217 R, 217 T, 51/237 R, 237 T, 419; 269/43, 152, 246; 279/1 DC, 1 D, 83

[56] References Cited

U.S. PATENT DOCUMENTS

| | | | |
|---|---|---|---|
| 272,672 | 2/1883 | Fawcett | 51/217 R |
| 1,537,520 | 5/1925 | Abbott | 51/164.1 |
| 1,774,530 | 9/1930 | Sheehan | 269/287 |
| 2,289,683 | 7/1942 | Rzeppa et al. | 51/217 R |
| 2,480,238 | 8/1949 | Hammond et al. | 51/7 |
| 3,331,166 | 7/1967 | Brenning | 51/217 R |
| 3,378,918 | 4/1968 | Closset | 51/237 R |
| 3,721,142 | 3/1973 | Csaki | 279/83 X |
| 4,447,992 | 5/1984 | Bergquist | 51/163.1 |
| 4,666,138 | 5/1987 | Dearman | 269/43 |

FOREIGN PATENT DOCUMENTS

| | | | |
|---|---|---|---|
| 0075159 | 12/1952 | Denmark | 279/83 |
| 965296 | 6/1957 | Fed. Rep. of Germany . | |

*Primary Examiner*—Frederick R. Schmidt
*Assistant Examiner*—Shirish Desai
*Attorney, Agent, or Firm*—Oblon, Fisher, Spivak, McClelland & Maier

[57] ABSTRACT

A jig for finishing of the blades of a turbo machine and which includes a cylindrical body on the peripheral of which are formed seatings and an annular strap or collar serves to lock the blades in place. A flange enables the jig to be mounted on a driving machine when the jig is partly immersed in an abrasive-containing enclosure which serves to effect the desired finishing of the blade tips or roots which protrude beyond one end of the cylindrical body.

6 Claims, 3 Drawing Sheets

JIG OR OTHER TOOLING ARRANGEMENT

BACKGROUND OF THE INVENTION

1. Field of the Invention The present invention relates to a jig or other tooling arrangement for the automatic finishing of the blades or vanes of a turbo machine. The term "blade" as used herein is intended to cover both rotary blades and also static vanes such as inlet guide vanes of turbo machines.

2. Description of the Prior Art

The manufacturing sequences for turbo machine blades which can be produced, depending upon the spheres of use, temperatures and loads applied and also depending upon the alloys used, either by forging, or by various casting procedures, generally involve machining operations or other operations of shaping by removal of material. Such operations are applied particularly to the roots and the tips of the blades to which are connected the aerofoil portions which have aerodynamic characteristics adapted to their function within the fluid flows of the turbo machine. The severe quality requirements imposed on vital parts of current turbo machines, particularly within the aeronautical sphere, lead to the provision following these conventional machining operations (milling, rectification) of finishing operations in the machined zones for example radius adjustment, de-burring and/or polishing. These operations involve a "manual" operation, requiring the personal intervention of qualified personnel and have previously been effected manually by way of a fitting operation.

Research into constant and repetitive results, into their repercussions both on the service life and duration of the life of the parts and into various performance aspects of the turbo machine relating to the balancing qualities or of the consistency in the influence on the aerodynamic disturbances, has however led to further research into automating these operations of finishing in the manufacture of turbo machine blades. Depending upon specific applications, various procedures have been considered for practical application on the basis of various different principles but these have hardly been used. In this respect reference can be made, by way of example, to electrolytic polishing operations or again, the use of moving bands or rotary brushes with the addition at the interface with the parts of various abrasive products, of various pastes or liquid suspensions. In certain cases, the results aimed at can be combined with supplementary effects (surface hardening for example) and in this category various processes for the projection of abrasives are to be found (dry sanding or moist sanding, for example).

Various disadvantages of practical operation or inadequate matching to the results sought in certain applications has lead in such cases to making use of another process of automatic deburring and radius adjustment of the blades of a turbo machine for the practical application of which tooling arrangements in accordance with the invention can be used. According to this previously proposed process, the blade is introduced into a bed formed by abrasive grains in a liquid for the deburring and radius adjustment of the end portions and this is effected in zones of the blade (root and tip) having previously been subjected to machining operations by rotating the blade within the abrasive bed. Preferably alternating rotational cycles are applied to the blade. Also preferably, the abrasive bed is constituted by moist corundum and the choice of the granular characteristics is determined as a function of the application under consideration. This kind of process has for example been applied by using corundum having a mean granular size 1590 m together with water. For applying a process of this kind, FIG. 1 of the accompanying drawings illustrates as a diagrammatic perspective view, one example of a prise art, jig or other support tooling arrangement intended for mounting of a blade and adapted at one end for mounting on a spindle or other mounting means of the machine for the introduction and for the rotation of the blade in a moist corundum bed placed in an enclosure. This tooling arrangement, comprises a hollow cylindrical body 1 carrying at one end a mounting flange 2 comprising mounting holes 3 and at the other end three parts constituting a locking mandrel, one part 4 being fixed and two others 5*a* and 5*b* cooperating with part 4. The parts of the mandrel 5*a* and 5*b* are pivotal, the pivoting being effected by two levers 6*a* and 6*b* rigid with the parts 5*a* and 5*b* and mounted on two pivots defined by clevises 7*a*, 7*b* and pins 8*a*, 8*b*. The blade 9 to be deburred is mounted on a sleeve 1*a* of an elastomer and which is locked between the parts of the mandrel 4, 5*a* and 5*b*. This jig has, however, various disadvantages and has led to various difficulties when in use. Blocking and frequent seizures of the pivot arrangements result from the introduction of grains or corundum, in spite of cleaning carried out after each operation and of multiple manipulations which result from it.

SUMMARY OF THE INVENTION

According to the present invention there is provided in a jig a cylindrical body having a plurality of seatings extending axially of the outer periphery of the body, the seatings being regularly distributed around the periphery and each being shaped to receive the aerodynamic portion of a turbomachine blade with an end portion of each blade protruding beyond one end face of the cylindrical body, means at the opposite end of the cylindrical body for mounting the jig on a drive mounting of an associated driving machine, and means attached to and surrounding the cylindrical body for locking the blades in the respective seatings.

According to one preferred embodiment the locking means comprise an annular collar surrounding the cylindrical body, spaced from it and rigid with said body by connecting tabs and, perpendicular to each seating formed in the cylindrical body, a locking bolt traversing the said collar and of which one end is adapted to abut for locking purposes on the cooperating surface of the aerodynamic portion of the blade.

According to a second embodiment of the invention, the locking means comprise, an annular strap or collar comprising two pivotal half straps, each mounted at one end on a support pivot rigid with the cylindrical body and at the other end of means associated with closure and locking and, resilient laminae, of the flat spring type, secured at their centers on the said cylindrical body and carrying at each end perpendicularly to each location formed on the cylindrical body a shoe, each shoe being adapted to abut for locking purposes on the cooperatingn surface of the aerodynamic portion of the blade and is held in this position by abutment and locking of the resilient laminae by the annular strap when closed and locked.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENTS

Figure 2:
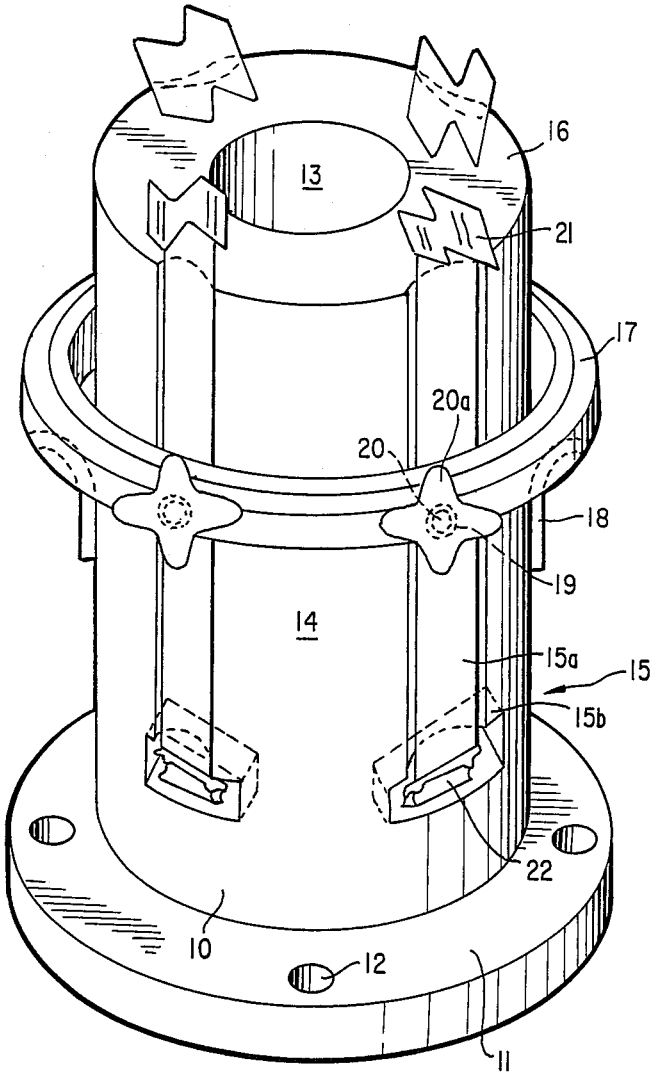
FIG. 2 is a perspective view of a first embodiment of a tooling arrangement in accordance with the present invention.

A first embodiment of a jig or other tooling arrangement in accordance with the invention illustrated in FIG. 2 comprises a cylindrical body 10 rigid with a base 11 in the form of an annular flange provided with mounting holes 12. The cylindrical body 10 comprises an internal bore 13 open at both ends. On the outer peripheral cylindrical surface of the body 10 elongate recesses in the form of seatings 15 are provided, four in number in the example illustrated, and these are regularly distributed around the perpiphery 14, parallel to the axis of rotation of the jig.

The seatings 15 open onto a plane upper face 16 of the cylindrical body 10 at the end opposite to the mounting flange 11. The seatings 15 are intended to support the turbo-machine blades and therefore each comprises two parts, one part 15*a* having a cross-section which reproduces the corresponding complementary profile of the aerodynamic portion of the blade or vane and the other part 15*b* being intended to receive an end portion of the blade or vane. The part 15*a* opens out into the upper face 16 while the part 15*b* forms a relatively deeper cavity or recess in the body 10.

An annular collar 17 surrounding at a distance the cylindrical body 10 is rigidly connected to the body by securing tabs 18. This collar 17 has, extending normally to the seatings 15, screw-threaded bores 19 in which securing bolts 20 are engaged, thus traversing the collar and of which the heads 20*a* located on the outside of the collar permit manual adjustment. Each blade has a conventional tip portion 21.

Figure 1:
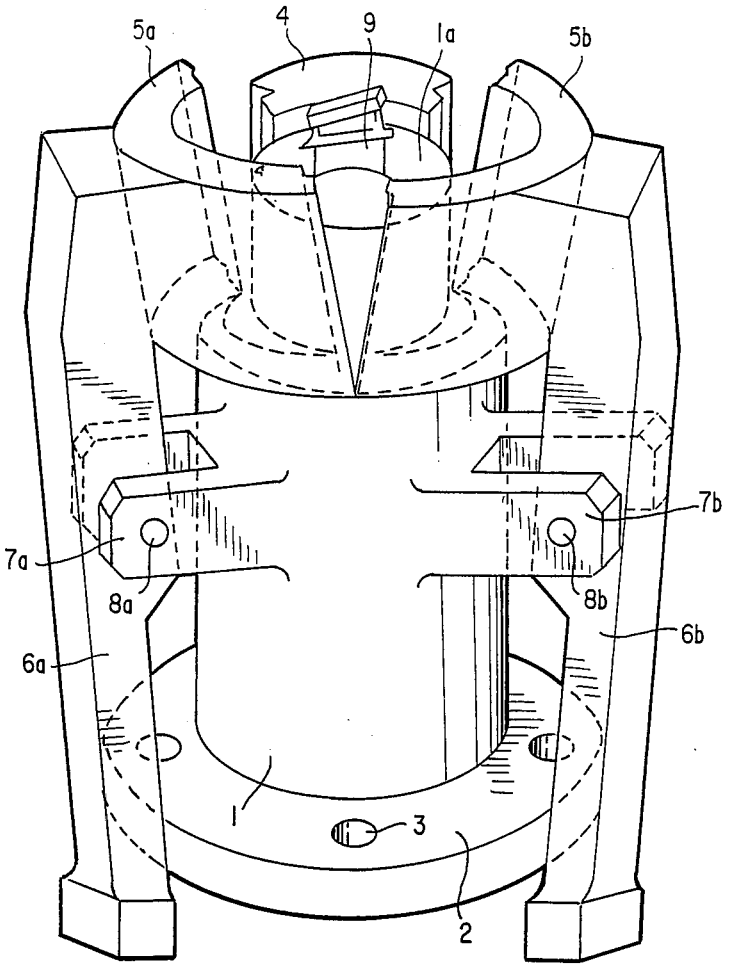
FIG. 1 PRIOR ART
FIG. 1 is a perspective view of the tooling arrangement of the prior art which has been described above.
Figure 3:
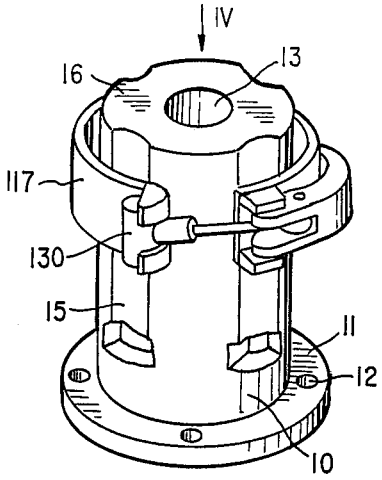
FIG. 3 is an external perspective view of a second embodiment of a tooling arrangement according to the invention.
Figure 4:
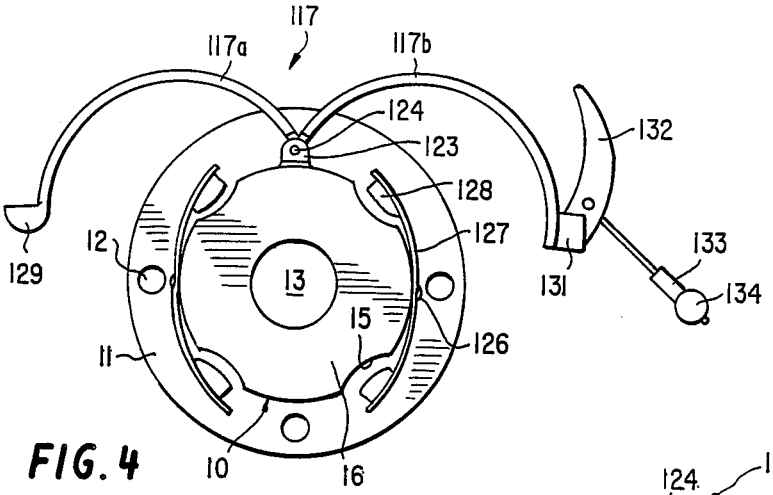
FIG. 4 is a plan view in the direction of the arrow IV shown in FIG. 3, with the tooling arrangement in an open configuration before loading with a blade or vane.
Figure 5:
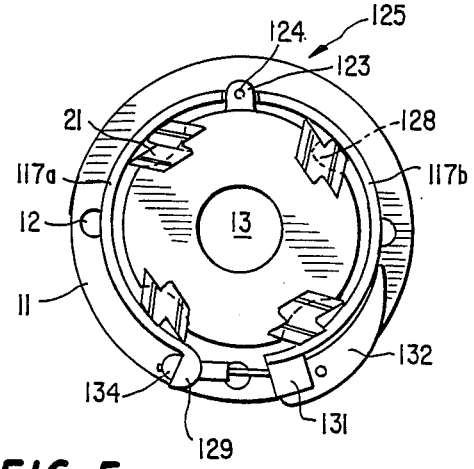
FIG. 5 is a plan view similar to that of FIG. 4, but in a closed configuration after loading with a blade or vane.

The operation and use of this jig briefly described, are as follows:

After locating of the blades or vanes in the seatings 15 and tightening of the bolts 20, the tip portion 21 of each blade projects with respect to the plane face 16 of the cylindrical body 10. After mounting of the jig by the mounting holes 12 of the flange 11 on the spindle or other mounting arrangement of an appropriate machine (not shown), the jig partially is immersed and rotated, in alternating cycles in one sense and then the other, within a humidified corundum bed disposed in an enclosure (not shown). The action of the abrasives is thus exerted on the roughness existing after machining on the ends of the blades, the head 21 in the example illustrated. The reversal of the blades or vanes in the seatings 15 enables treatment of the second ends, the root 22 in the example shown, in a second operation similar to the first. In relation to the prior solution hereinbefore described with reference to FIG. 1, the jig gives rise to substantial advantages: time saving, improvement in the service life of the jig without parts thereof being subjected to rapid wear, availability and a greater simplicity and facility of use, without the need to grip or cramp the parts. F IGS. 3 to 5 illustrate a second embodiment of a jig embodying theinvention in which the cylindrical body 10 again comprises the base 11 and the seatings 15. The only different parts are the locking means of the blades or vanes after location on the jig. The cylindrical body 10 carries a clevis 123 which, associated with pin 124, defines a support pivot 125 on which are pivoted the ends of two half straps 117*a* and 117*b* together forming an annular strap or collar 117 surrounding the cylindrical body 10 and capable of assuming an open position as illustrated in FIG. 4 or of a closed position, as illustrated in FIGS. 3 and 5. In the example illustrated, at right angles with respect to the pivot support 125, seen in plan, as for example in FIG. 4, the cylindrical body 10 carries, at each side, a rivet 126 or any other equivalent securing means which supports resilient laminae 127 of the flat spring type. At each end of each resilient lamina 127 a shoe 128 is provided provided, lying normal to the respective seating 15.

The second end of each half strap 117*a* and 117*b* comprises associated means for closure and locking of the strap 117 to form a collar having a similar action to the collar 17 of the first embodiment. The end of the half strap 117*a* comprises an outwardly extending protruberance 129 of a semi cylindrical shape. This member 129 is divided to form an opening 130. The end of the half strap 117*b* comprises a support element 131 on which is pivoted a pawl member 132 which carries a pivotal rod 133. This rod 133 is terminated by a cylindrical member 134 intended for engagement in the semi-cylindrical member 129.

As illustrated in FIG. 5, after location of the blades or vanes in the seatings of the jig the half straps 117*a* and 117*b* are brought together so that they can be clamped on to the resilient laminae 127 causing the shoes 128 to engage the aerodynamic portions of the blades, the surface of each shoe 128 being so formed that its profile adapts perfectly to the corresponding profile of the blades. The end portion of the blade or vane to be treated, such as the tip portion 21 in the example illustrated, thus protrudes beyond the plane face 16 of the cylindrical body 10 as is provided in the first embodiment hereinbefore described. The end of the rod 133 is engaged in the opening 130 and when the pawl-like member 132 is snapped into its closure position (FIG. 5), the cylindrical member 134 locks itself in the hollow part of the semi cylinder member 129, thus ensuring the tight locking of the assembly. Otherwise the use of the jig is identical to that hereinbefore described in relation to the first embodiment.

Obviously, numerous modifications and variations of the present invention are possible in light of the above teachings. It is therefore to be understood that within the scope of the appended claims, the invention may be practiced otherwise than as specifically described herein.

I claim:

1. A jig, comprising:

a cylindrical body having a plurality of seatings formed therein extending axially of the outer periphery of the body, the seatings being regularly distributed around the outer periphery and each being shaped to receive the aerodynamic portion of a turbomachine blade with an end portion of each blade protruding beyond one end face of the cylindrical body, means disposed at the opposite end of the cylindrical body for mounting the jig on a drive mounting of an associated driving machine, and means attached to and surrounding the cylindrical body for locking the blades in the respective seatings formed therein.

2. A jig according to claim 1, wherein the cylindrical body has a bore open at both ends and the one end face is planar.

3. A jig according to claim 1, wherein the mounting means comprises an annular flange having mounting holes therein.

4. A jig according to claim 1, wherein the locking means comprises adjustable members serving to hold the individual blades in the respective seatings.

5. A jig according to claim 1 wherein the locking means comprise an annular collar fixed to and surrounding the cylindrical body, connecting tabs fixing the collar to the body and locking bolts traversing the collar and of which one end of each bolt is adapted to abut a cooperating surface of the aerodynamic portion of the blade of the corresponding seating.

6. A jig according to claim 5, comprising four said seatings for the blades and four said bolts for locking the blades in the seatings.

* * * * *